US005170637A

United States Patent [19]

Shyu

[11] Patent Number: 5,170,637

[45] Date of Patent: Dec. 15, 1992

[54] AIR CONDITIONER WITH OXYGEN GENERATOR

[75] Inventor: Jia-Ming Shyu, Hsinchu City, Taiwan

[73] Assignee: Norm Pacific Automation Corp., Taiwan, Taiwan

[21] Appl. No.: 689,478

[22] Filed: Apr. 23, 1991

[51] Int. Cl.[5] ..... C25B 9/00; F24F 3/16

[52] U.S. Cl. ..... 62/176.1; 62/78; 204/242

[58] Field of Search ..... 62/78, 285, 176; 204/242

[56] References Cited

U.S. PATENT DOCUMENTS 3,415,310 12/1968 Kuhlmann ..... 62/78 X 4,896,514 1/1990 Takashi ..... 62/78 X

FOREIGN PATENT DOCUMENTS 2460462 2/1981 France ..... 62/285

*Primary Examiner*—William E. Wayner

*Attorney, Agent, or Firm*—Spencer, Frank & Schneider

[57] ABSTRACT

An oxygen generator accompanied with an air conditioner comprises a reservoir for collecting condensed water outside the evaporator, an electrolyzer for electrolizing the water from the reservoir to produce oxygen, and a controller for controlling the operation of the electrolyzer and providing suitable amount of oxygen into the room.

7 Claims, 1 Drawing Sheet

AIR CONDITIONER WITH OXYGEN GENERATOR

BACKGROUND OF THE INVENTION

This invention relates to an oxygen generator in an air conditioner to increase the content of indoor oxygen.

A conventional air conditioner is usually operated in a closed room (house, vehicle, etc . . .) where the indoor air is circulated internally. The waste air (such as carbon dioxide from the exhalation of human body and from the operation of the machine, or odour, or gas which is harmful to the human) can not be expelled out immediately. Thus, the density of indoor waste air increases, and oxygen content decreases simultaneously. People who stay in the room for quite a time will gradually feel dizzy, will find it difficult to breathe and, as a result their work performance will be reduced. The conventional air conditioner, in general, has a manual air-exchange valve, but when it is manipulated incorrectly, the result of no air exchange or excess air exchange that reduces the cooling effect and/or increases energy consumption may happen. In addition, due to pressure differences between indoor and outdoor, and poor quality of outdoor air, air exchange is very likely to take in outdoor impurities or polluted air sometimes.

SUMMARY OF THE INVENTION

This invention, to solve the problems mentioned above, provides an oxygen generator accompanied with an air conditioner equipped with automatic air exchange control devices to generate and supply sufficient oxygen to the indoors.

The characteristic of this present invention is to set up a reservoir under an evaporator and its fan in an air conditioner to collect condensed water outside the evaporator. An electrolyzer electrolyzes the water to generate oxygen and hydrogen according to the needed air exchange rate, and then the generated oxygen is sent to the indoor air outlet of the air conditioner and therefore provides oxygen into the indoor air. The electrolyzed hydrogen can be burned out or be oxidized by way of catalysis in low temperature and becomes vapor. Meanwhile, the indoor polluted air can be expelled by a fan of the condenser.

The features and advantages of this invention will be detailedly described with the appended figure as follows.

DETAILED DESCRIPTION OF THE INVENTION

Figure 1:
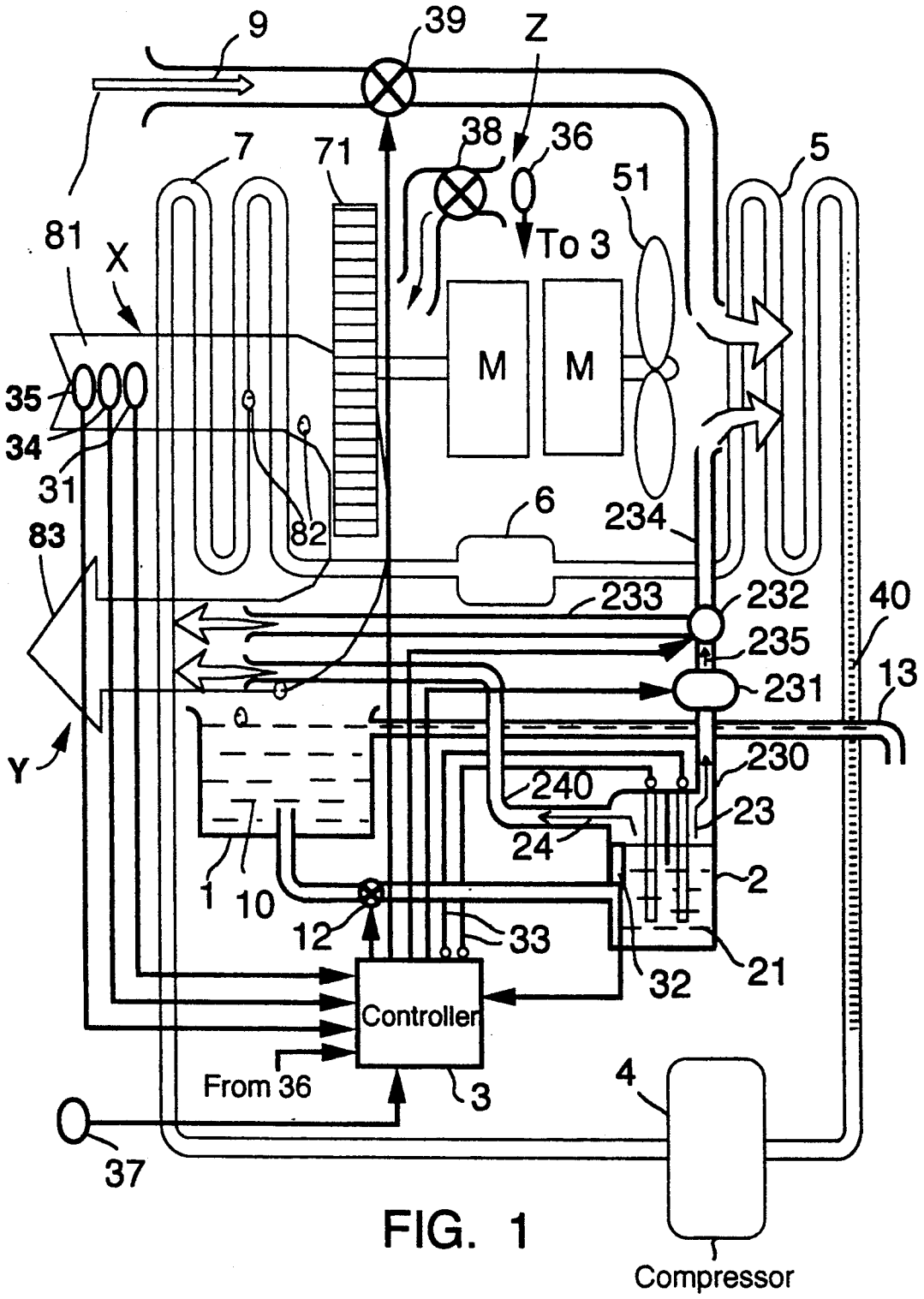
FIG. 1 is a schematic view of an embodiment of the invention accompanied with an air conditioner.

As the FIGURE shows, the air conditioner in the embodiment of this invention includes a compressor 4, a condenser 5, a control unit 6 for regulating evaporation (such as a capillary tube or an expansion valve), an evaporator 7, a fan 51 and a fan 71 to control the heat exchange efficiency of the condenser 5 and the evaporator 7 respectively, and refrigerant 40 circulating in the tube. When the indoor air 81,83 is circulated by the evaporator fan 71, humid/warm air 81 sucked in through an inlet X is cooled down by removing some humidity while the air passes through the evaporator 7, and becomes dry/cool air 83 which returns to the room through an outlet Y. The water drops 82 condensed outside the evaporator 7 are collected by a reservoir 1 under the evaporator 7 and the fan 71. An overflow tube 13 on the top of the reservoir 1 discharges the flow-out water (which can also be used to help dissipate the heat of the condenser 5 by being sprayed on the condenser. The water 21 in the electrolyzer 21 is supplied from water 10 of reservoir 1 through an on/off control valve 12 controlled by a controller 3 based on a level detector 32 mounted on the electrolyzer 2. If water 10 is not sufficient to provide the quantity of water needed by the electrolyzer, then water from outside the air conditioner is added to the reservoir. The power supply 33 for the electrolyzer 2 is controlled by the controller 3 based on the detected values of oxygen content detectors 31 and 36 located in the inlet X and an outdoor air inlet Z (for air exchange) respectively and the volume of air exchange through the outdoor air inlet Z is controlled by a control valve 38. The required amount of electrolysis can be obtained to produce the required indoor oxygen. The hydrogen 23 produced from the electrolyzer 2 can be sent by a conduit 230 to a burner 231 to be burned. The vapor 235 resulting from burning the hydrogen can be expelled out through a conduit 234 by the fan 51, or be converged to the outlet Y by way of a conduit 233 controlled by a conduit valve 232, and mixed with the cooled air 83 to be sent indoors. The choice as between these two alternatives is controlled by the controller 3 based on the the status of indoor humidity detected by a humidity detector 35. While oxygen 24 conveyed through a conduit 240 mixes with the cooled air 83 if necessary, a certain amount of indoor air 81 can be led through a conduit controlled by a control valve 39, to the nearby area of the fan 51 and expelled out. The exhaust amount is determined by the controller 3 based on an indoor carbon dioxide detector 34. Another manner to control the amount of electrolysis and the amount of exhaust is based on the number of persons in the room which is detected by detectors such as a pyroelectric infrared sensor 37 (which are of prior arts and will not be detailedly described herein). In a word, the oxygen generator in the air conditioner can supply indoor air full of oxygen which does the human body good and enhances the performance of work as well.

The above described embodiment, in practice, can also be applied to some other room or vehicular air conditioning or ventilating equipments, such as humidifier, dehumidifier, cooler/heater, etc. Although the invention has hereinabove been described with respect to the illustrated embodiment, it is understood that the invention is capable of modification and variation, and is limited only by the following claims.

What is claimed is:

1. An oxygen generator, installed in an air conditioner which contains at least a cooling device for cooling at least indoor air, comprising:

a reservoir for storing water condensed from air which air is cooled off while passing through said cooling device:

an electrolyzer;

means for directing water from said reservoir to said electrolyzer;

said electrolyzer for electrolyzing water into oxygen and hydrogen;

means for directing oxygen from said electrolyzer indoors; and a controller for controlling water supply to said electrolyzer and the electrolysis volume to provide the required indoor oxygen.

2. The oxygen generator of claim 1, wherein the electrolysis volume is controlled by said controller based on a value detected by an indoor oxygen content detector comparing with a preset value.

3. The oxygen generator of claim 1, including means to direct polluted indoor air to the outdoors, wherein, while the oxygen is directed indoors, a suitable amount of polluted indoor air is expelled outdoors through a valve controlled by said controller based on a value detected by an indoor carbon dioxide content detector comparing with a preset value.

4. The oxygen generator of claim 1, including means to vaporize hydrogen, and means to direct hydrogen vapor outdoors, wherein the hydrogen obtained from electrolysis is converted to vapor and selectively conveyed indoors and outdoors through a valve controlled by said controller based on a value detected by an indoor humidity detector comparing with a preset value.

5. The oxygen generator of claim 2, wherein the electrolysis volume is controlled by said controller further based on a value detected by an outdoor oxygen content detector.

6. The oxygen generator of claim 1, wherein the electrolysis volume is controlled by said controller based on the number of persons in the room which is detected by a detector.

7. The oxygen generator of claim 6, wherein, while the oxygen is sent indoors, a suitable amount of polluted indoor air is expelled out through a valve controlled by said controller.

* * * * *